US007402020B2

(12) United States Patent
Beers et al.

(10) Patent No.: US 7,402,020 B2
(45) Date of Patent: Jul. 22, 2008

(54) ACM COOLING FLOW PATH AND THRUST LOAD DESIGN

(75) Inventors: Craig Beers, Wethersfield, CT (US); Christopher McAuliffe, Windsor, CT (US); Brent Merritt, Southwick, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 244 days.

(21) Appl. No.: 11/302,712

(22) Filed: Dec. 14, 2005

(65) Prior Publication Data

US 2007/0134105 A1 Jun. 14, 2007

(51) Int. Cl.
*F01D 25/16* (2006.01)
*F01D 25/12* (2006.01)

(52) U.S. Cl. ..... 415/1; 415/107; 415/230; 415/104; 416/198 A

(58) Field of Classification Search ..... 415/104, 415/107, 211.2, 115, 230; 416/198 R, 198 A, 416/175; 417/406, 407; 62/402
See application file for complete search history.

(56) References Cited

U.S. PATENT DOCUMENTS 4,507,939 A * 4/1985 Wieland ..... 62/402
5,130,670 A * 7/1992 Jaffe ..... 331/2
5,224,842 A * 7/1993 Dziorny et al. ..... 417/406
6,151,909 A * 11/2000 Carter et al. ..... 62/402

* cited by examiner

*Primary Examiner*—Ninh H Nguyen
(74) *Attorney, Agent, or Firm*—Carlson, Gaskey & Olds

(57) ABSTRACT

An air cycle machine includes a housing having a compressor housing portion. A shaft is supported by the housing and includes a thrust runner. A hydrodynamic thrust bearing is arranged adjacent to the thrust runner and includes upstream and downstream sides. A compressor rotor is mounted on the shaft. A seal is arranged between the compressor rotor and the compressor housing portion. An orifice is provided in the compressor housing portion at the downstream side of the hydrodynamic bearing. The orifice vents hot compressed air that may leak past the seal prior to reaching the hydrodynamic thrust bearing.

14 Claims, 3 Drawing Sheets

ACM COOLING FLOW PATH AND THRUST LOAD DESIGN

BACKGROUND OF THE INVENTION

This invention relates to a cooling flow path used for the thrust bearing of an air cycle machine.

One type of air cycle machine uses a radial outflow compressor that is driven by two radial turbines. The compressor and turbines are supported on a common shaft and ride upon hydrodynamic bearings in a housing. A pair of hydrodynamic, foil-type journal bearings support the shaft. The shaft includes a thrust runner. Axial forces imparted on the shaft are counteracted by a pair of thin foil hydrodynamic thrust bearings arranged on either side of the thrust runner.

Various seals are used in the housing to separate the flow into and out of the compressor and turbines seals also help define a cooling path in the housing. Airflow through the cooling path cools the hydrodynamic bearings. One problem has been that hot air from the compressor outlet can leak past a seal between the compressor rotor and housing. The leaked hot compressor air has then flowed through the hydrodynamic thrust bearings, which can reduce their life.

What is needed is an improved cooling path to address leakage from the compressor and route the leakage around the hydrodynamic thrust bearings.

SUMMARY OF THE INVENTION

The invention provides an air cycle machine that includes a housing having a compressor housing portion. A shaft is supported by the housing and includes a thrust runner. A hydrodynamic thrust bearing is arranged adjacent to the thrust runner and includes upstream and downstream sides. A compressor rotor is mounted on the shaft. A seal is arranged between the compressor rotor and the compressor housing portion. An orifice is provided in the compressor housing portion at the downstream side of the hydrodynamic bearing.

The orifice vents hot compressed air that may leak past the seal prior to it reaching the hydrodynamic thrust bearing. The cooling flow through the hydrodynamic thrust bearing exits at a first bearing exit cavity. The orifice fluidly connects the first bearing exit cavity to a low pressure side of the seal. The high pressure side of the seal is in fluid communication with a compressor outlet.

Accordingly, the present invention provides an improved cooling path to address leakage from the compressor and route the leakage around the hydrodynamic thrust bearings.

These and other features of the present invention can be best understood from the following specification and drawings, the following of which is a brief description.

DETAILED DESCRIPTION OF THE PREFERRED EMBODIMENT

Figure 1:
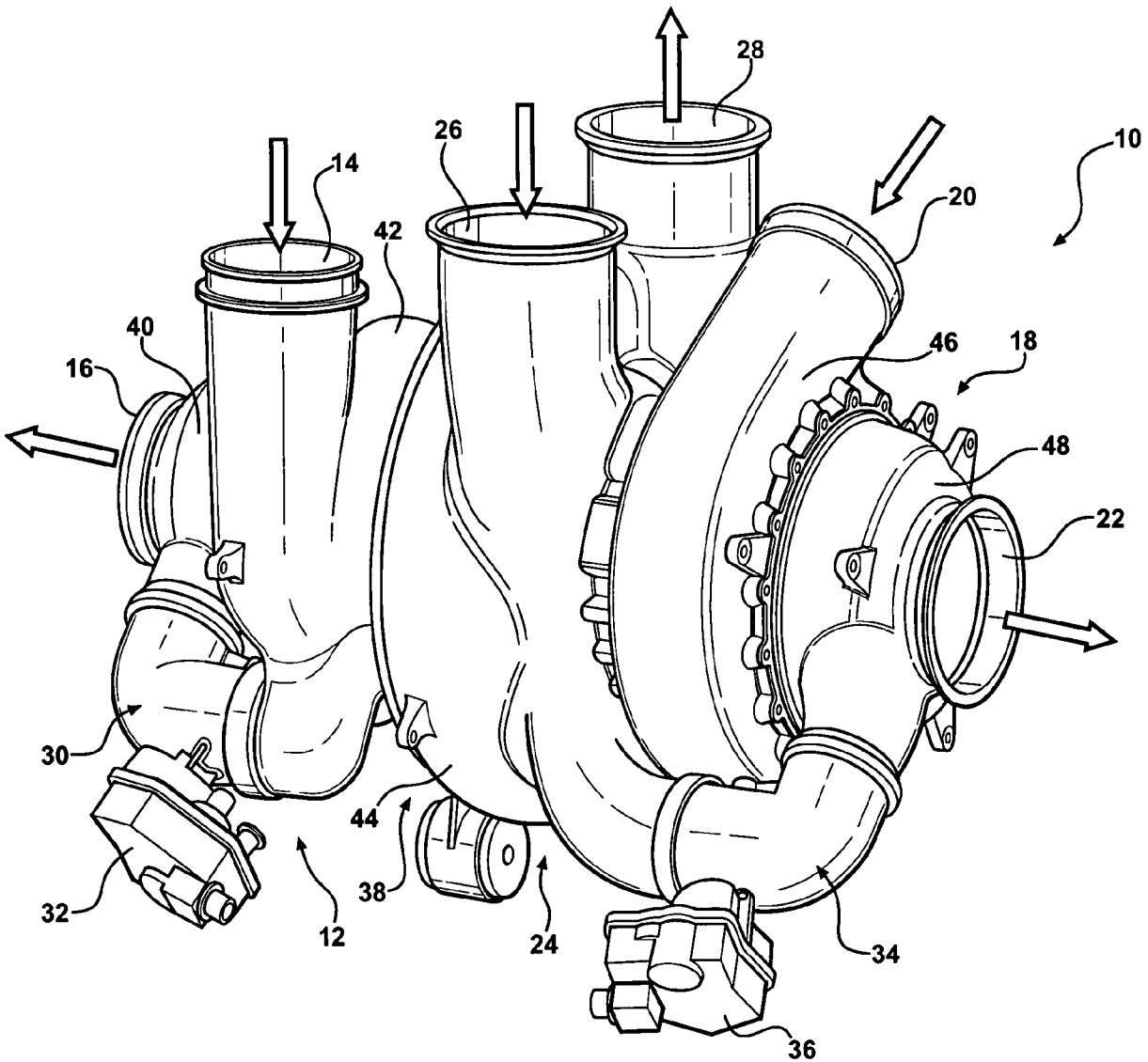
FIG. 1 is a perspective view of an air cycle machine.
Figure 2:
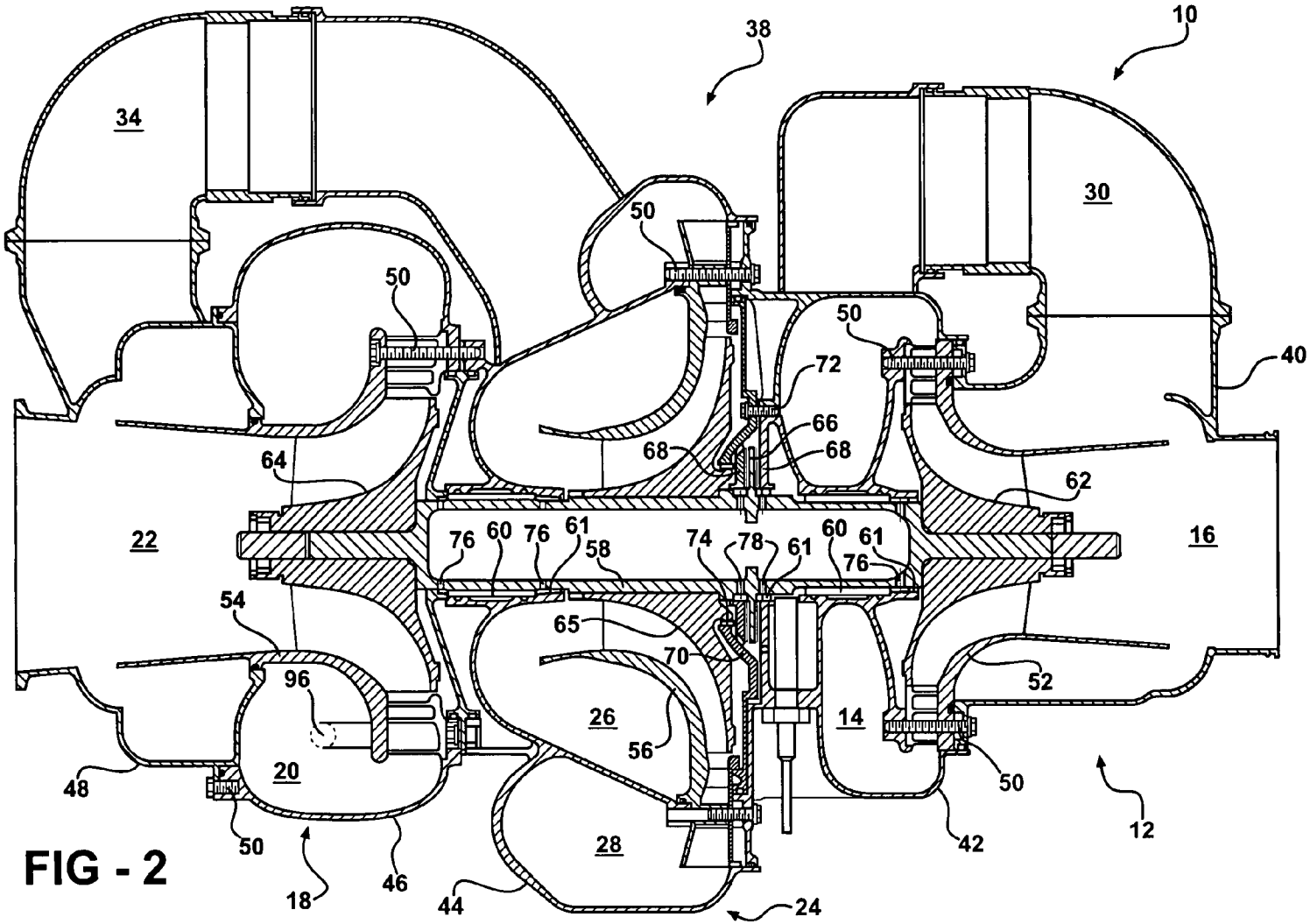
FIG. 2 is a cross-sectional view of the air cycle machine shown in FIG. 1.

An air cycle machine (ACM) 10 is shown in FIGS. 1 and 2. The ACM 10 includes a first turbine 12 having an inlet 14 and outlet 16. A second turbine 18 has an inlet 20 and outlet 22. A compressor 24 is driven by the first and second turbines 12 and 18. The compressor 24 includes an inlet 26 and outlet 28. A low limit passage 30 is arranged between the first turbine inlet 14 and outlet 16 with a low limit valve 32 regulating the fluid flow between them. A bypass passage 34 is arranged between the compressor inlet 26 and second turbine outlet 22 with a bypass valve 36 regulating the fluid flow between them.

The ACM 10 includes first, second, third, fourth, and fifth portions 40, 42, 44, 46 and 48 secured to one another using fasteners 50. The first and second portions 40 and 42 provides a housing for the first turbine 12. The fourth and fifth portions 46 and 48 provide a housing for the second turbine 18. The third portion 44 provides a housing for the compressor 24. The housing 38 also includes first and second turbine shrouds 52 and 54 and a compressor shroud 56.

A hollow shaft 58 is supported in the housing 38 by hydrodynamic journal bearings 60. Cooling flow is shown passing through apertures 76 into the hollow of the shaft 58 to distribute the cooling air to the journal bearings 60 and hydrodynamic thrust bearing 68. Seal 61 are arranged near the hydrodynamic journal bearings 60 to direct cooling flow through the hydrodynamic journal bearings 60 in a desired manner, which is shown by the arrows in FIGS. 3 and 4. A reverse J tube 96 is arranged in the second turbine inlet 20 to provide clean air to the cooling path.

First and second turbine rotors 62 and 64 and a compressor rotor 65 are mounted on the shaft 58. A thrust runner 66 extends radially outwardly from the shaft 58 to counter axial loads from the rotors 62, 64 and 65. A hydrodynamic thrust bearing 68 is arranged on either side of the thrust runner 66.

Figure 3:
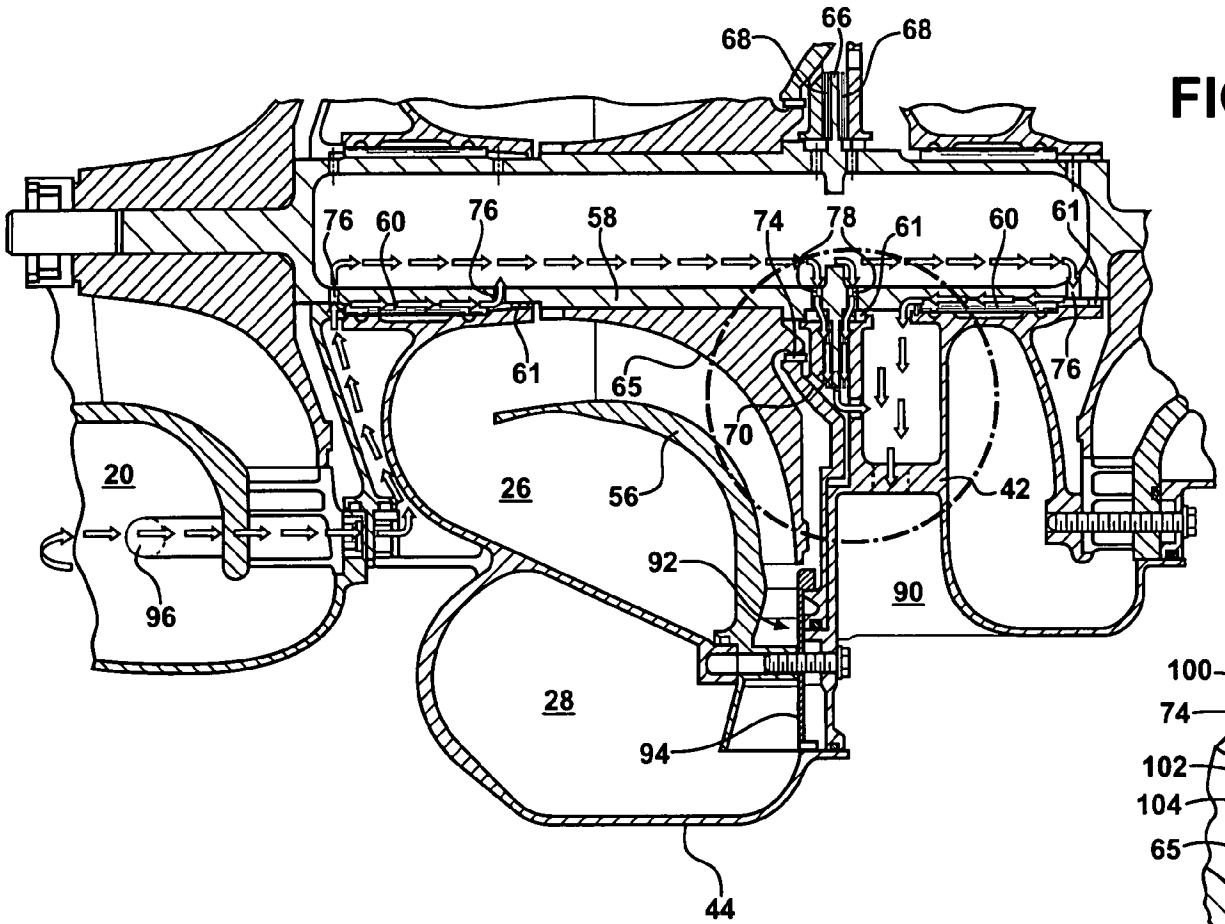
FIG. 3 is an enlarged view of a portion of the air cycle machine shown in FIG. 2.
Figure 4:
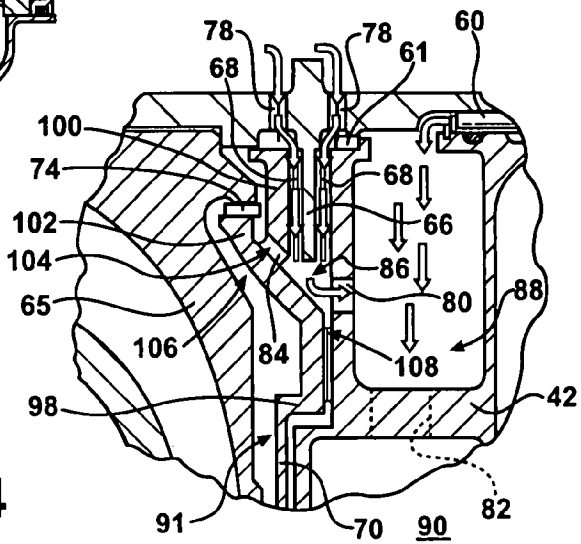
FIG. 4 is a further enlarged view of portion of the air cycle machine shown in FIG. 3.

Referring to FIGS. 2 and 3, the housing 38 includes a compressor seal plate 70 arranged between the compressor rotor 65 and the second portion 42 and is secured to the second portion 42 by fasteners 72, best shown in FIG. 2. A diffuser 92 is arranged near the compressor rotor 65 at the compressor outlet 28. A diffuser backing plate 94 is used to retain the compressor seal plate 70 between the diffuser backing plate 94 and the second portion 42. The compressor seal plate 70 is exposed to compressed air from the compressor outlet 28. A seal 74 is arranged between the compressor seal plate 70 and the compressor rotor 65. Occasionally, hot compressed air leaks past the seal 74. In prior art ACMs, this hot compressed air has flowed to the upstream side of the hydrodynamic thrust bearings 68 thereby introducing hot air into the bearings.

The compressor seal plate 70 includes first, second and third legs 98, 100 and 102 that meet at a joint 104. A first bearing exit cavity 86 is provided between the compressor seal plate 70 and the second portion 42 at an outlet or downstream side of the hydrodynamic thrust bearing 68. A hole 80 in the second portion 42 enables the first bearing exit cavity 86 to fluidly communicate with a second bearing exit cavity 88 provided in the second portion 42. The second bearing exit cavity 88 receives cooling flow exhausted from the hydrodynamic journal bearings 60. A vent 82 in the second portion 42 exhausts the cooling flow to a ram outlet 90.

The compressor seal plate 70 includes compressor side 106 that is exposed to a cavity 91 behind the compressor rotor 65. A bearing side 108 of the compressor seal plate 70 is arranged near the second portion 42. Hot compressed air in the cavity 91 leaks past the seal 74. An orifice 84 is provided in the compressor seal plate 70 in the second leg 100 near the joint 104. The orifice 84 is arranged on the downstream side of the hydrodynamic thrust bearings 68 and in fluid communication with the first bearing exit cavity 86. The orifice 84 is sized to direct the hot compressed air flow to the first bearing exit cavity 86 instead of flowing toward the inlet side of the hydrodynamic thrust bearings 68, as was the case with prior art ACMs. In this manner, hot compressed air does not flow through the hydrodynamic thrust bearing, which would reduce their life.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor, comprising:

a housing including a compressor housing portion;

a shaft supported in the housing and having a thrust runner, a hydrodynamic thrust bearing adjacent to the thrust runner, the hydrodynamic thrust bearing having upstream and downstream sides, and a turbine rotor and a compressor rotor mounted on the shaft;

a seal arranged between the rotor and the housing portion, and an orifice in the housing at the downstream side of the hydrodynamic thrust bearing; and wherein the housing includes a turbine housing portion with the turbine rotor arranged in the turbine housing portion, the thrust runner arranged between the compressor and turbine housing portions, a first bearing exit cavity arranged between the compressor and turbine housing portions at the downstream side, the compressor housing having compressor and bearing sides respectively expose to the compressor rotor and the first bearing cavity.

2. The compressor according to claim 1, wherein a second turbine rotor is mounted on the shaft, the compressor rotor arranged between the turbine and second turbine rotor.

3. The compressor according to claim 1, wherein the turbine rotor is arranged in the housing, the housing providing a turbine inlet and turbine outlet, and a reverse J-tube arranged in the turbine inlet, the reverse J-tube providing fluid to the upstream side of the hydrodynamic thrust bearing.

4. The compressor according to claim 1, wherein the housing includes a turbine housing portion with the turbine rotor arranged in the turbine housing portion, the thrust runner arranged between the compressor and turbine housing portions, the turbine housing portion including a hole in fluid communication with a ram air outlet.

5. The compressor according to claim 1, wherein a second bearing exit cavity is provided by the turbine housing portion, a hole fluidly connecting the first and second bearing cavities, the second bearing cavity fluidly communicating with a ram air outlet.

6. The compressor according to claim 1, wherein the compressor housing portion is a compressor seal plate secured to the turbine housing portion by a fastener.

7. The compressor according to claim 6, wherein a diffuser is arranged at a compressor outlet and includes a diffuser backing plate, and the compressor seal plate is secured between the turbine housing portion and the diffuser backing plate.

8. The compressor according to claim 1, wherein the compressor housing portion is generally Y-shaped and includes first, second and third legs, the first let supporting the seal, the second leg providing the orifice, and the third leg secured to the turbine housing portion.

9. The compressor according to claim 1, wherein the shaft is hollow, the shaft including apertures permitting cooling fluid to flow through the hollow to the upstream side, the cooling fluid flowing through the hydrodynamic thrust bearing to the downstream side.

10. The compressor according to claim 9, wherein the housing includes a compressor outlet having compressed fluid, the compressed fluid acting on and leaking past the seal, the compressed fluid flowing through the orifice and commingling with the cooling fluid at the downstream side.

11. A method of cooling a hydrodynamic bearing in a compressor comprising the steps of:

a) sealing between a compressor rotor and a compressor housing portion;

b) flowing cooling fluid through a hydrodynamic bearing arranged between a thrust runner and the compressor housing portion;

c) leaking hot compressed fluid from the compressor rotor past a seal; and d) flowing the hot compressed fluid through an orifice in the compressor housing portion to route the hot compressed fluid around the hydrodynamic bearing.

12. The method according to claim 11, comprising step e) merging the cooling fluid and the hot compressed fluid downstream from the hydrodynamic bearing relative to the cooling fluid flow.

13. The method according to claim 12, comprising step f) venting the cooling fluid and hot compressed fluid to a ram air outlet.

14. The method according to claim 11, wherein the seal is arranged between the compressor rotor and compressor housing portion.

* * * * *

UNITED STATES PATENT AND TRADEMARK OFFICE

CERTIFICATE OF CORRECTION

PATENT NO. : 7,402,020 B2
APPLICATION NO. : 11/302712
DATED : July 22, 2008
INVENTOR(S) : Beers et al.

It is certified that error appears in the above-identified patent and that said Letters Patent is hereby corrected as shown below:

Claim 1, Column 3, line 32: “expose” should read as --exposed--

Claim 8, Column 4, line 14: “let” should read as --leg--

Signed and Sealed this

Fourteenth Day of October, 2008

JON W. DUDAS
*Director of the United States Patent and Trademark Office*